US005274878A

United States Patent [19]

Radabaugh et al.

[11] Patent Number: 5,274,878

[45] Date of Patent: Jan. 4, 1994

[54] REMOTE CONTROL SYSTEM FOR CENTRAL VACUUM SYSTEMS

[75] Inventors: Kurtis R. Radabaugh; Jon H. Tippin; Eugene J. Maher, Jr., all of Ponca City, Okla.

[73] Assignee: Cen-Tec Systems Inc., Bloomington, Ill.

[21] Appl. No.: 734,633

[22] Filed: Jul. 23, 1991

[51] Int. Cl.[5] ..... A47L 5/38

[52] U.S. Cl. ..... 15/314; 15/339; 15/412

[58] Field of Search ..... 15/314, 339, 412, 377

[56] References Cited

U.S. PATENT DOCUMENTS 1,055,985 3/1913 Berger .
1,368,736 2/1921 Lavigne .
1,806,871 5/1931 Bower .
1,872,372 8/1932 Wensley .
2,998,474 8/1961 Pavlic .
3,283,226 11/1966 Umpleby et al. .
3,300,571 1/1967 Downey .
3,314,039 4/1967 Opper .
3,366,766 1/1968 Umpleby .
3,382,524 5/1968 Sandstrom .
3,536,836 10/1970 Pfeiffer .
3,555,170 1/1971 Petzetakis .
3,579,706 5/1971 Hetland ..... 15/377 X
3,626,545 12/1971 Sparrow .
3,749,947 7/1973 Kawada et al. .
3,814,542 6/1974 Iglesias et al. .
3,855,665 12/1974 Schwartz ..... 15/339
3,965,526 6/1976 Doubleday .
4,225,272 9/1980 Palmovist .
4,368,348 1/1983 Eichelberger et al. .
4,382,543 5/1983 Morrison .
4,473,923 10/1984 Neroni et al. .
4,490,575 12/1984 Kutnyak .
4,494,270 1/1985 Ritzau et al. .
4,611,365 9/1986 Komatsu et al. ..... 15/377 X
4,654,924 4/1987 Getz et al. ..... 15/339 X
4,693,324 9/1987 Choiniere et al. .
4,829,626 5/1989 Harkonen et al. .
4,854,887 8/1989 Blandin .
4,881,909 11/1989 Blackman .
4,991,253 2/1991 Rechsteiner ..... 15/314 X

*Primary Examiner*—Chris K. Moore
*Attorney, Agent, or Firm*—Wm. Bruce Day

[57] ABSTRACT

A remote control system for actuating a central vacuum system from a remote location such as a vacuum cleaning hose handle without the use of a separate, dedicated system of control wires. In a preferred embodiment, a small, lightweight FM radio frequency signal transmitter is installed in the hose handle and the signal is conducted along the household current 60 Hz wires running through the vacuum cleaner hose and wand for the purpose of providing electrical current to power sweeper brush motors. The piggybacked control signal requires no additional conductor wires, such as the low voltage wiring of conventional control systems, thereby saving weight and costs. The control signal travels along the power supply wires running the length of the vacuum hose, which are preferably covered by a sleeve, such as of cloth or plastic, then through a standard plug into a standard electrical outlet. A receiver located near the central vacuum cleaner system receives the control signal from the house wiring and processes it to start or stop the central vacuum system main motor.

7 Claims, 4 Drawing Sheets

REMOTE CONTROL SYSTEM FOR CENTRAL VACUUM SYSTEMS

BACKGROUND OF THE INVENTION

1. Field of the Invention

The present invention is directed to remote control of central vacuum systems. More particularly, the present invention is directed to an assembly using an electrical switch in a vacuum cleaner wand/hose end which transmits a signal to actuate a motor in the central vacuum system.

2. Background of the Invention

Central vacuum systems are popular in a variety of buildings, notably family residences. A typical central vacuum system includes a vacuum pump connected to an electric motor for driving it, a plenum for generating a vacuum and duct work to another plenum for collecting debris in a vessel such as a bag and allowing exhaust air to be vented. The motor, vacuum pump and plenums are generally located in the basement or other relatively remote location within a house. A network of tubing or ducts connects the central vacuum cleaner to each of the rooms to be serviced. One or more vacuum hose connection points are located in each of the rooms to be serviced. These openings are generally covered by an airtight flap or valve to prevent the induction of air through unused openings and to maintain a vacuum within the system. A hose with a wand end is connected to one of the connection point openings when that room is to be vacuumed. The wand normally includes a handle for the user to hold and a suction head for drawing in the air and collected debris.

A difficulty with prior central vacuum systems lies with turning the central vacuum motor on and off conveniently and reliably. The distance from the location of the wand, or working point, to the central pump motor generally prohibits a switch located on the vacuum motor. Because of the normal basement location of the central pump motor, climbing up and down stairs every time the user desires to use the system is inconvenient and tiring. As a result, several approaches to this problem of providing a convenient switch for operating the vacuum motor have been developed in the prior art.

One such attempted resolution involved mounting an electrical switch on the handle of the portable hose and routing two low voltage wires along the hose to a coupling ring on the end of the hose. When the hose is fastened to the wall opening outlet, as by use of a bayonet mount or screw mount, contact points on the coupling ring engage matching contact points on the fitting in the wall opening. The contact points on the wall opening fixture are connected to a light gauge wire pair that runs along the tubing to an electrical relay which switches the vacuum motor on and off. This system suffers from three serious disadvantages. First, it is inordinately expensive to provide hoses and tubing or ducts having a wire pair running the length of the hose and tubing. Second, these wires are prone to breakage, creating an open circuit that is difficult to locate and expensive to repair. Third, because the cleaning implement is often subject to rough use and handling, the contact points on the coupling members frequently wear out or break, preventing the user from switching the system on.

An alternative approach to solving this problem is disclosed in U.S. Pat. No. 4,829,626, issued to Harkonen et al. on May 16, 1989. Harkonen discloses a method for controlling a vacuum cleaner that includes a battery operated electrical sound signal generator mounted in the handle of the wand. When the signal generator is activated, it generates and transmits a sound signal through the tubing, which in turn is sensed by a receiver which generates an electrical pulse to start the motor of the vacuum cleaner. In the Harkonen system, when an operating lever located in the handle is moved to the on position a flap in the wand opens, allowing air to be drawn through the wand and the network of tubing to the vacuum cleaner and permitting the sound generated by the electrical signal generator to travel more easily to the receiving equipment located close to the vacuum cleaner motor. The sound signal is only generated momentarily in order to start the motor. Once the sound signal has been transmitted for the predetermined brief time, the sound generator is turned off. If the motor has started as intended, the motor keeps running until the flow of air through the system is blocked. It is intended that the flap in the hose near the wand be manually swung into a position across the inlet of the hose, thereby blocking the flow of air. Then a detector detects the stopping of the flow of air and, in response, turns off the vacuum motor.

This proposed solution also suffers from several disadvantages. First, a chemical battery is required for operating the sound generator. The battery will necessarily run down and require replacement. More importantly, if the operator is not careful in the use of the machine, an old or run down battery may leak corrosive chemicals into the sensitive and delicate sound generation equipment, ruining it. The battery and sound generator combination also occupy a significant volume within the handle of the wand, making the wand heavier, larger, and more unwieldy.

Perhaps the greatest difficulty with the method of Harkonen lies in the means for stopping the vacuum cleaner. In the normal course of using a vacuum cleaner, many possible events that could block the flow of air through the hose suggest Harkonen themselves. In some cases, merely pressing the vacuuming head hard against a surface to be vacuumed can block the flow of air sufficiently to cause the vacuum motor to stop. This is particularly the case when the vacuum head is operated near or on non-porous materials. Further, items too large to pass conveniently through the tubing may be inadvertently sucked into the vacuum head, thereby turning it off.

Accordingly, there is a need for a remote control switching system for central vacuum systems that can reliably be turned on from the wand without direct connections back to the main power unit. Additionally, there is a need for a central vacuum system that includes a monitoring function to evaluate unit performance and signal when vacuum pressure drops excessively.

SUMMARY OF THE INVENTION

In a preferred embodiment, the instant invention includes a mechanism control signal which piggy-backs onto standard household current through an electrical power cord that runs the length of the vacuum cleaner hose and which is used to power appliances mounted at the hose end, such as a carpet sweeper. The electrical power cord is attached along the length of the vacuum hose by a smooth plastic sleeve and has a plug end plugged into a standard household electrical distribution wall socket. The control signal travels through the house wiring and is sensed by a signal receiver co-located with the central vacuum system pump motor to activate the pump motor and cause operation and deactivation of the vacuum system. In a preferred embodiment, the control signal is a frequency modulated (F.M.) R.F. signal.

The vacuum cleaning system also includes a pressure sensitive switch which signals when vacuum pressure falls below a predetermined level, so that a clogged or partially clogged condition may be corrected by the user.

OBJECTS OF THE INVENTION

Accordingly, it is the primary object of the present invention to provide a remote control switching mechanism for central vacuum systems that allows the central vacuum pump motor to be turned on from the wand without direct connection to the main power unit.

It is a further object of the present invention to provide a remote control switching arrangement which alleviates any need for separate low voltage control wires.

It is further the object of the present invention to provide a remote control switching mechanism for central vacuum systems that relies on a piggy-back modulated radio signal traveling over house or building wiring coded to a matching receiver.

It is a further object of the present invention to streamline the aesthetic and functional aspects by providing an attractive non-convoluted sleeve covering the vacuum hose and insulated electrical conductors, thus protecting the conductors, the hose, the consumer's furniture and woodwork. The unique ergonomically designed handle incorporates electrical, inlet and outlet, switches for on, off and power nozzle on and off functions and an indicator lamp which will remain on while unit is running.

It is a further object of the present invention to provide a means for monitoring the vacuum pressure of a vacuum cleaning system to signal partial or complete obstructions to air flow.

DETAILED DESCRIPTION OF THE PREFERRED AND ALTERNATE EMBODIMENTS

As required, a detailed embodiment of the present invention is disclosed herein, however, it is to be understood that the disclosed embodiment is merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
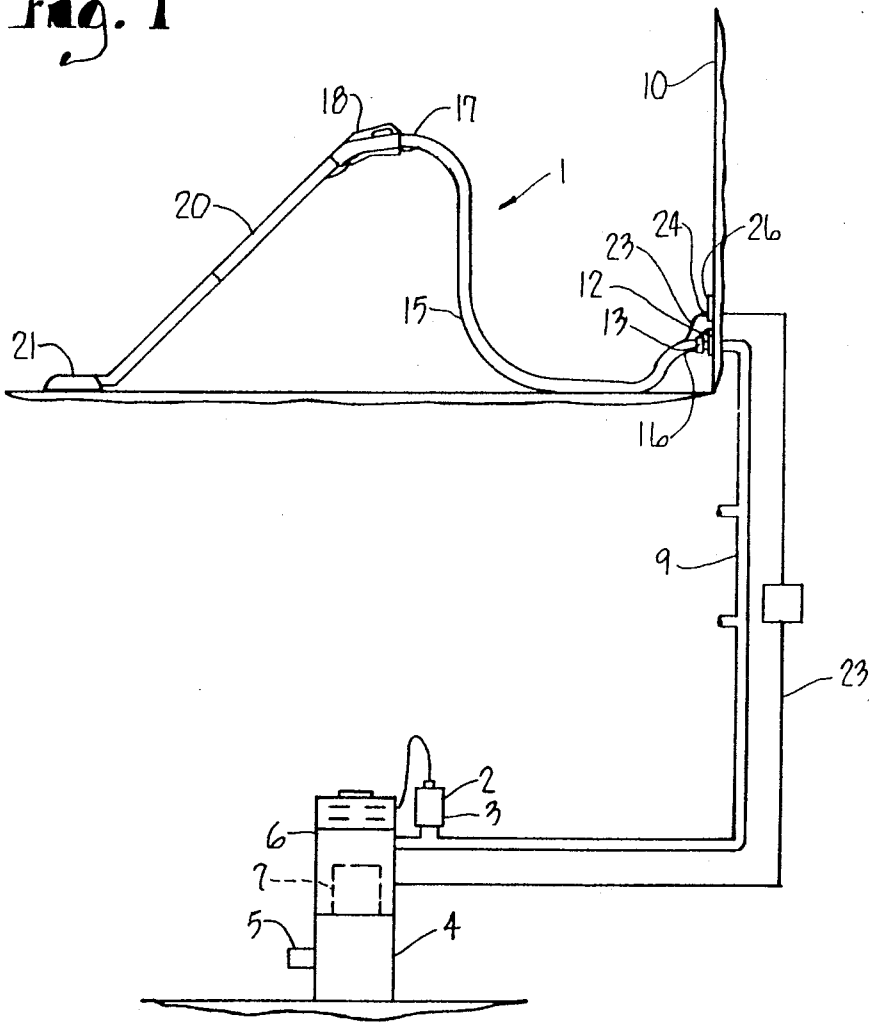
FIG. 1 is a plan view of a central vacuum cleaning system embodying the present invention.

Referring to FIG. 1, there is shown a central vacuum cleaning system including a vacuum pump 2 connected to an electric motor 3 for driving it, a plenum 4 for generating a vacuum and duct work 5 to another plenum 6 for collecting debris in a vessel such as a bag 7 and allowing exhaust air to be vented. The motor 3, vacuum pump 2 and plenums 4 and 6 are generally located in the basement or other relatively remote location within a house. A network of tubing or ducts 9 connects the central vacuum cleaner to each of the rooms 10 to be serviced. One or more vacuum hose connection points 12 are located in each of the rooms 10 to be serviced. These openings are generally covered by an air-tight flap or valve 13 to prevent the induction of air through unused openings and to maintain a vacuum within the system. A hose with a wand end is connected to one of the connection point openings when that room is to be vacuumed. In the example shown in FIG. 1, a vacuum hose 15 has one end 16 inserted into the connection point 12 and a distal end 17 connected to a hose handle 18. A wand 20 is connected to the hose handle 18 and a cleaning implement fitted to the end of the wand 20. In the illustrated embodiment, an electrically operated cleaning appliance 21 is connected to the end of the wand 20, wherein the appliance 21 may be a carpet sweeper brush with an electric motor used to run a rotating brush. To route electrical power to the appliance, a power line 23 is combined with the vacuum hose 15 as hereinafter described and includes one end 24 plugged into a wall socket 26 carrying household electrical current, which, in the United States, is a standard system having a 110–125 volt AC current at 60 Hertz. The power line 23 is routed through the hose handle 18 to a connection 27 at the end of the hose handle 18 whereupon a second segment of power line 23 from the appliance 21 can be plugged into the connection 27 if the use of such an appliance 21 is desired.

The present invention is directed to a transmitter, such as located in the hose handle 18, that is remotely positioned from the central vacuum cleaner pump motor 3 and is used to generate an electrical signal which is applied to wiring within the appliance power line 23. The electrical signal is a control signal and is transmitted throughout the house on the house current wiring. A receiver is generally proximately positioned to the central vacuum cleaning pump motor 3, such as within or without the motor pump housing, and is also connected to the house AC main wiring. The receiver detects the control signal applied to the house wiring by the transmitter and turns on and off the vacuum motor 3 in response to the received control signals.

Figure 2:
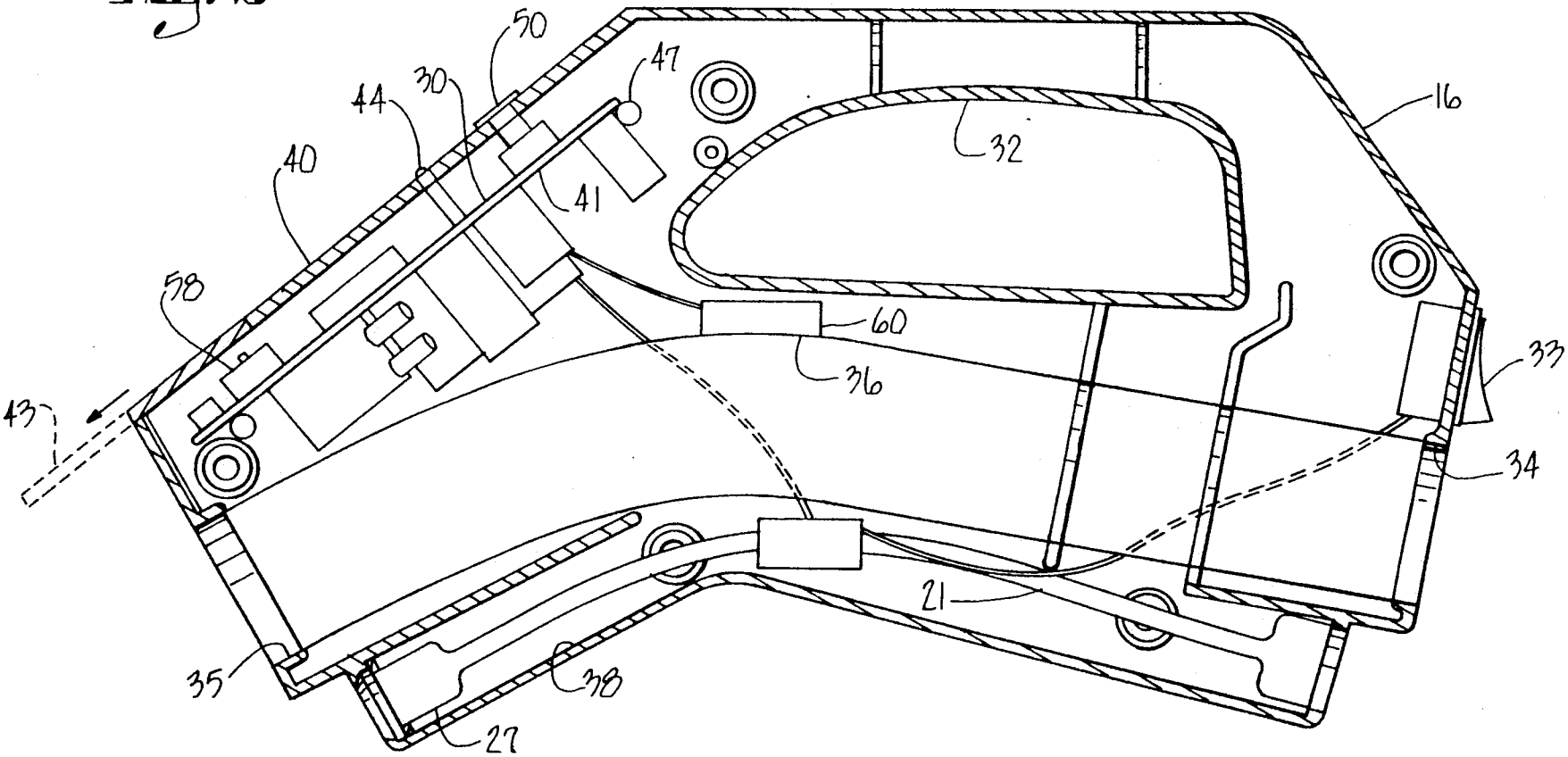
FIG. 2 is an enlarged longitudinal sectional view of a handle assembly for a central vacuum cleaning system including a transmitter assembly.
Figure 6:
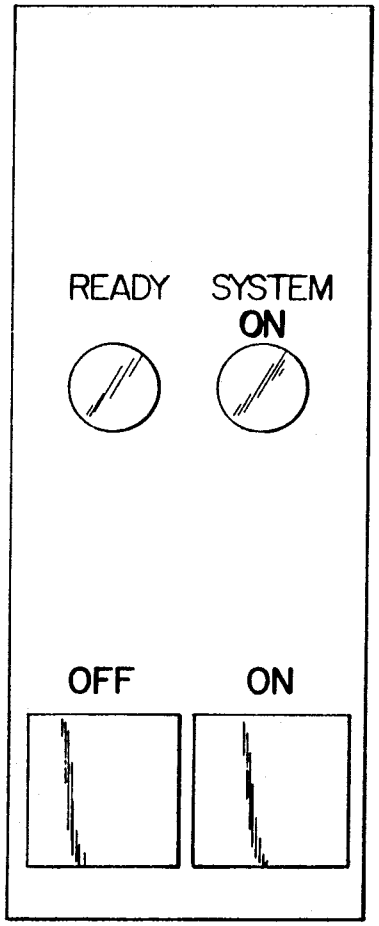
FIG. 6 is an enlarged view of a facia panel for the handle assembly.

In the illustrated example, FIGS. 1 and 2, a transmitter 30 is mounted within the hose handle 18, although it will be appreciated that the transmitter may be located in virtually any convenient place. In the illustrated example, the hose handle 18 includes a hand hold 32, a switch 33 for operation of the power brush appliance 21 and inlet and outlet openings 34 and 35 for a vacuum tube 36. The appliance power line 23 runs in a bottom channel 38, along the handle 18. A front facia section 40 conceals a circuit board 41 containing the transmitter 30. The facia section 40, as best shown in FIGS. 2 and 6, includes a sliding portion 43, FIG. 2, providing a door covering a code switch described hereinafter. Indicator lights, such as LEDs 44 and 45 protrude through the facia section 40 to indicate operation of the vacuum cleaner system. In particular, the LED 44 is preferably red in color and indicates the system is ready for operation; e.g., that the hose is plugged into the vacuum and electrical outlet. If the LED 44 illuminates during operation of the system, or after the start button 50 is depressed, it then indicates a plugged hose by the vacuum falling below a preset level. The LED 45 is preferably green in color and indicates that the system is on and operating with sufficient vacuuming pressure. Manually operable switches 50 and 51 protrude through facia section 40 and reset between off and on positions. The circuit board 41 is appropriately retained within the hose handle 18 by suitable mounts 47.

Figure 3:
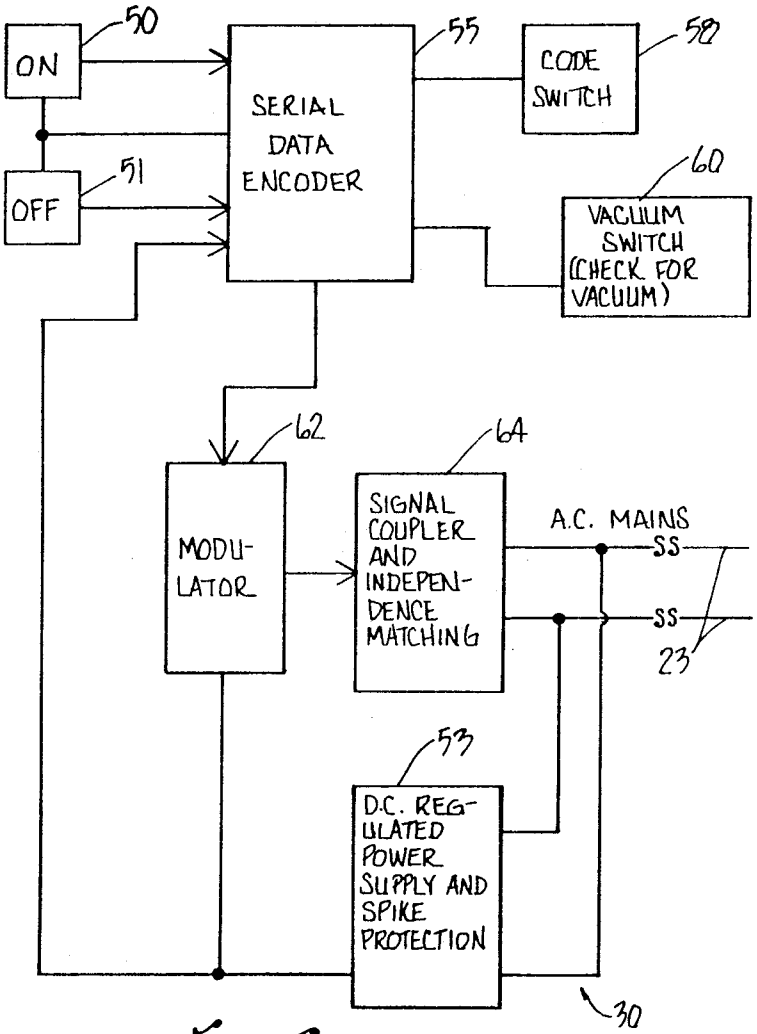
FIG. 3 is a block diagram of the transmitter assembly.

Turning to FIG. 3, the transmitter 30 is shown diagrammatically and includes on/off switches 50 and 51, which protrude through facia section 40. Power to the switches 50 and 51 is provided by a DC regulated power supply 53 connected to the AC power line 23 and which converts the 110/125 volt AC current to approximately 9 volts DC regulated current. Additionally, the DC power supply 53 includes spike clamps in order to attenuate voltage transients, as caused by lightning or the like.

Power is supplied from the DC power supply 53 to an encoder 55. In the illustrated example, the encoder 55 is a serial data encoder integrated circuit microchip manufactured by Motorola and is a MC145026 chip. The MC145026 chip will encode nine bits of information and serially transmit this information upon receipt of a transmit enable signal. Each transmitted data bit is encoded into two data pulses. A logic zero is encoded as two consecutive short pulses, a logic one as two consecutive long pulses, and an open as a long pulse followed by a short pulse. The input state is determined by using a weak output device to try to force each input first low, then high. If only a high state results from the two tests, the input is assumed to be hard-wired to $V_{DD}$. If only a hard state is obtained, the input is assumed to be hard-wired to $V_{SS}$. If both a hard and a low can be forced at an input, it is assumed to be opened and is encoded as such. The chip includes a $\overline{TE}$ input, having an internal pull-up device so that a simple switch may be used to force the input low. While $\overline{TE}$ is high, the encoder is completely disabled, the oscillator is inhibited and the current drain is reduced to quiescent current. When $\overline{TE}$ is brought low, the oscillator is started, and the transmit sequence begins. The inputs are then sequentially selected, and determinations are made as to the input logic states. The information is serially transmitted via a data out output pin.

To provide a preselected code to the encoder 55, a code switch 58 regulates the encoder 55. The code switch 58 is composed of a DIP switch assembly which enables the user to select over 4,000 different identification codes. The sliding portion 43 on the facia section 40 covers the DIP switches. Presumably, the code switch 58 would have to be selected only once, during initial installation of the system and thereafter, the user would need no access to the DIP switch assembly 58. The code switch 58 is to provide a substantially unique identification code so that adjoining central vacuum cleaning systems, as in adjoining houses or apartments, are not improperly activated by signal spill-over on the AC main lines.

The two switches 50 and 51 control the serial data encoder 55 so that when the user pushes the on switch 50, the circuit senses data from the code switch plus data from a code internal to the encoder 55 for that one switch. Pushing the off switch 51 provides the code data from the off switch 51 plus the code internal to the encoder 55.

The transmitter 30 includes a monitoring or check circuit to the encoder 55 including a vacuum switch 60. The vacuum switch 60 is set to actuate upon sensing a preset level and is associated with the vacuum tube 36 running through the handle 18. It includes a mechanical diaphragm and a potentiometer to monitor and sense vacuum. The switch 60 sends a code signal to the encoder 55 to illuminate the LED 44, if vacuum falls below a predetermined level or is absent, as in the instance of vacuum hose 15 being pulled free from the valve 13. The vacuum switch 60 also indicates a low air flow, such as caused by a full dust bag or a clogged system.

The output of the encoder 55 is a serial data stream to a modulator 62. In a preferred form, the modulator is a 120 kilocycle modulator made by National Semiconductor Corporation, integrated circuit chip LM1893. The modulator 62 takes the serial data code from the encoder 55 and puts it on a carrier of 120 kilocycles. The carrier signal is transmitted continuously or at close intervals of approximately every 5 seconds for system safety. The output of the modulator 62 is carried to a signal coupler 64. The signal coupler 64 is preferably a 120 kilocycle signal coupler and provides an impedance match-up. The coupler 64 provides a transformer coupling that isolates the AC main current from the modulator 62 and provides a high impedance load to the AC line to block out all of the 60 cycles from the AC mains and send a 120 kilocycle signal.

Figure 4:
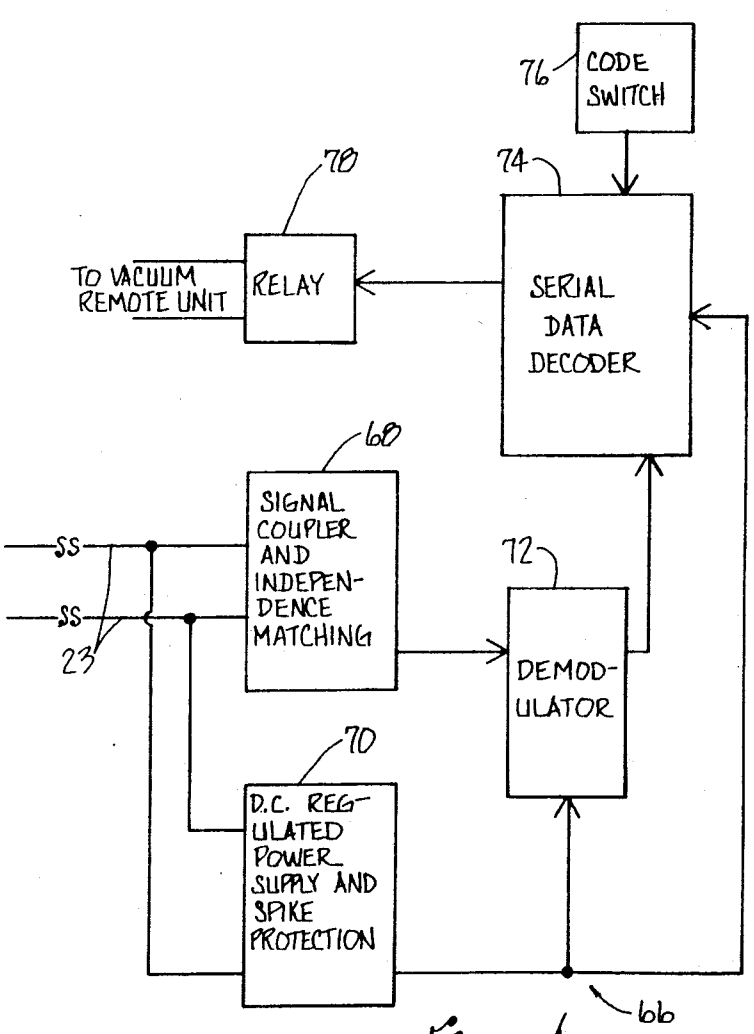
FIG. 4 is a block diagram of a receiver assembly.

Referring to FIG. 4, the control signal is applied to the AC main power supply line 23 that goes into the house wiring and over to a receiver 66. The receiver 66 performs all the functions of the transmitter 30 in reverse. The 120 kilocycle frequency modulated control signal piggy-backed on the AC main lines is first sensed by a signal coupler 68 corresponding to the signal coupling 64. The signal coupler 68 reduces the AC 60 Hertz from the house mains down to substantially a transparent cycle and only allows the 120 kilocycle control signal to pass. The coupler 68 effectively isolates the AC main current from the receiver circuit.

Like the transmitter 30, the receiver 66 is also powered by a DC power supply 70 which provides a 9 volt DC system and spike protection. The output of the signal coupler 68 is fed into a National Semiconductor LM1893 120 kilocycle demodulator 72 which is wired as a demodulator, or the reverse of the modulator 62. The demodulator 72 takes the 120 kilocycle modulated carrier and demodulates the carrier received continuously or approximately every 5 seconds so that the signal at the output is the serial data similar to or exactly like the serial data which came from the output of the encoder 55 in the transmitter 30.

The signal input into the serial data decoder 74 which is a corresponding pair Motorola chip MC145027. This decoder receives the serial data from the encoder and outputs the data if it is valid. The transmitted data, consisting of two identical data words, is examined bit by bit as it is received. The first five bits are assumed to be address bits and must be encoded to match the address input at the receiver. If the address bits match, the next four data bits are stored and compared to the last valid data stored. As the section encoded word is received, the address must again match, and if it does, the data bits are checked against the previously stored data bits. If the two words of data (four bits each) match, the data is transferred to the output data, latches by VT and will remain until new data replaces it. At the same time, the valid transmission output pin is brought high and will remain high until an error is received or until no input is received for four data bit times.

In the illustrated example, the receiver 66 is preferably emplaced within a case which similarly to the transmitter 30 includes switch 76, having DIP switches covered by a sliding door. Alternatively, the receiver 66 could be a separate component of the vacuum system. The code switch 76 is a twin to the code switch 58 and the codes set in each of the switches 58 and 76 should be identical. If not identical, the decoder 74 will indicate error and not output an enable signal. The output of the decoder 74 is to a relay 78, which starts and stops a vacuum pump electric motor 3, turning on and off the central vacuum cleaning system 1.

It will be noted that the piggy-backed signal, the 120 kilocycle FM modulated carrier, is the type of signal used in the present embodiment. However, the code signal to be operative must merely be distinct from the characteristics from the house wiring electrical signal so that an appropriate receiver may receive and isolate the control signals. Frequency modulation is employed for the present carrier because of its clarity and resistance to amplitude changes during lightning storms. Frequency modulation additionally keeps any noise from entering into the system so that the characteristics of the carrier input are also its output, even in a noisy environment.

In operational terms then, the central vacuum cleaning system 1 includes a central vacuum cleaning pump motor 3 and a vacuum hose 15 with a power supply line 23 for connection to a household current electrical supply. The vacuum cleaning system 1 includes a transmitter 30 which transmits a control signal, such as a radio frequency control signal over the appliance power line 23. The control signal has a cycle frequency distinct from the cycle frequency of the appliance power line 23. The system 1 includes a receiver 66 which receives and isolates the control signal from the appliance power line 23 and which then actuates the central vacuum cleaning pump motor 3 in response to receipt of the control signal.

Figure 5:
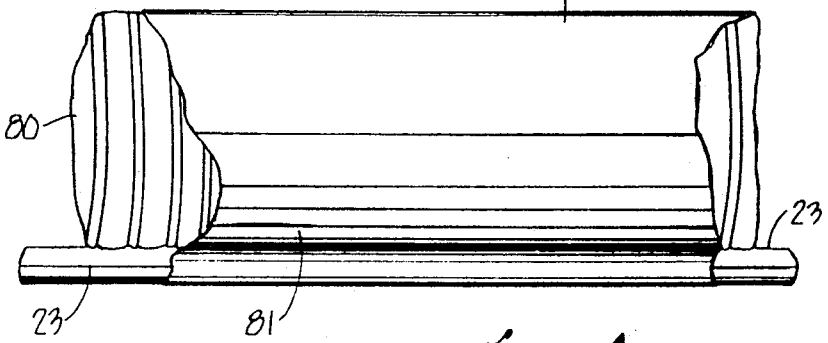
FIG. 5 is an enlarged view of a vacuum cleaner hose.

In FIG. 5 is shown an exemplary vacuum cleaning hose 15 which is particularly useful in conjunction with the present invention, although a non-sleeved hose could be used as an alternative. The vacuum cleaning hose 15 includes an elongate hose having its end 16 for connecting to a vacuum cleaner plenum 4 via the valve 13 and duct work 5 at a distal end 17, for connection to a cleaning appliance 21, such as an electrically driven carpet sweeper. The electrical power supply line 23 extends along the hose 15, such as parallel thereto and against the outer wall 80 of the hose 15. A sleeve 81 fits snugly extended over the hose 15 and the power supply line 23 and binds the power supply line to the hose. The sleeve 81 may be a heat shrinkable plastic which is pulled in its unshrunk condition tightly over the combined power line and hose and then heat is applied to the heat shrinkable sleeve so that it contracts tightly about the hose and power line to form a unitary structure. A second means of application of the sleeve 81 is to provide a vacuum expanded sleeve which is emplaced within a vacuum pulling bore and applied to the combined hose and power line by running the hose and power line through the bore. As the combined hose, power line and sleeve emerge from the vacuum chamber, vacuum is released and the sleeve becomes tightly bound to the underlying hose and power line. Additional shrinkage may be obtained through heating of the plastic sleeve, as by a hot air applicator.

A third means of applying a sleeve 81 tightly about the hose 15 and power line 23 is to co-extrude a plastic sleeve from an extruder about the hose and power line 23. In this circumstance, an extruder having an open central bore sized for receipt of the hoses provided and the hose and power line 23 fed through the extruder. As it emerges, the extruder forms and applies a cylindrical sleeve tightly about the hose. As the sleeve cools, it contracts even more snugly.

Figure 7:
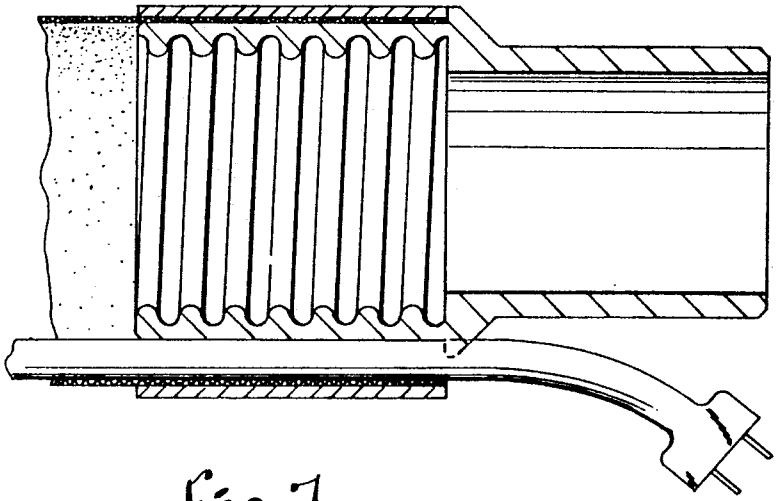
FIG. 7 is an enlarged view of a preferred embodiment of vacuum cleaner hose.

An alternative and presently preferable means of applying a sleeve about the hose 15 and power line 23 is shown in FIG. 7 and comprises a cloth sock 85 stretched tightly therearound. The sock 85 is secured at the hose ends by cuffs 86.

It is to be understood that while certain forms of this invention have been illustrated and described, it is not limited thereto, except insofar as such limitations are included in the following claims.

What is claimed and desired to be secured by Letters Patent is as follows:

1. A remote control arrangement for actuating a central vacuum cleaner motor comprising:

a) an electrical transmission line extending along a vacuum cleaner hose for operation of electrical appliances attached to an end of said hose;

b) a transmitter remotely positioned from said central vacuum cleaner motor and located generally at said vacuum cleaner hose end, and including;

i) a manually operable switch;

ii) means generating a radio frequency signal in response to operation of said switch; and iii) means for transmitting said radio frequency signal along said electrical transmission line;

c) a receiver proximately positioned to said central vacuum cleaner motor, and including;

i) means for detecting said radio frequency signal from said transmission line; and ii) actuator means responsive to said radio frequency signal to actuate said central vacuum cleaner motor.

2. In a central vacuum cleaning system, including a central vacuum cleaning pump motor and one or more remote operating locations and having a transportable vacuum cleaning hose with an electrical appliance power line extending along said hose, the improvement comprising:

a) a transmitter mounted on said hose and including a manually operable switch, means generating a radio frequency signal in response to operation of said switch, and means for transmitting said radio frequency signal along said appliance power line; and b) a receiver proximately positioned to said central vacuum cleaning pump and including means for detecting said radio frequency signal from said electrical appliance power line and actuator means responsive to said radio frequency signal to actuate said central vacuum cleaning pump motor.

3. A remote control arrangement for actuating a central vacuum cleaning system comprising:

a) a vacuum cleaner hose associated with a household current electrical power supply line for operation of electrical appliances attached to said hose;

b) a wand handle located at a distal end of said hose;

c) a transmitter assembly mounted in said handle and including:

i) a manually operable switch;

ii) an interface with said power supply line for providing electrical power to said transmitter assembly;

iii) an encoder for providing an electrical control signal;

iv) a modulator for frequency modulating said control signal at a cycle frequency distinct from the cycle frequency of said power supply line;

v) a coupler for applying said control signal to said power supply line;

d) a receiver assembly remotely positioned from said transmitter assembly and including:

i) an interface with said power supply line for providing electrical power to said receiver assembly;

ii) a decoupler receiving said control signal from said power supply line;

iii) a demodulator;

iv) a decoder for providing an electrical control signal; and v) a relay for actuation of a central vacuum cleaning system pump motor.

4. The arrangement set forth in claim 3 including:

a) a code selector for predetermining a code signal to be provided by said encoder; and b) a second code selector for predetermining a code signal to be accepted by said decoder.

5. The arrangement set forth in claim 3 including:

a) a vacuum switch communicating with said vacuum cleaner hose for transmitting an indicator signal in the absence of a predetermined vacuum in said hose.

6. The arrangement set forth in claim 5 wherein:

a) said vacuum switch transmits said indicator signal to said encoder.

7. A remote control arrangement for actuating a central vacuum cleaner motor comprising:

a) an electrical transmission line extending along a vacuum cleaner hose for operation of electrical appliances attached to an end of said hose;

b) a transmitter remotely positioned from said central vacuum cleaner motor and located generally at said vacuum cleaner hose end, and including;

i) a switch;

ii) means generating a radio frequency signal in response to operation of said switch;

iii) means for transmitting said radio frequency signal along said electrical transmission line;

c) a receiver associated with said central vacuum cleaner motor, and including;

i) means for detecting said radio frequency signal from said transmission line; and ii) actuator means responsive to said radio frequency signal to actuate said central vacuum cleaner motor.

* * * * *